US007073631B2

(12) United States Patent
Ludwig et al.

(10) Patent No.: US 7,073,631 B2
(45) Date of Patent: Jul. 11, 2006

(54) LIFTING DEVICE WITH SYNCHRONIZATION MECHANISM

(75) Inventors: Peter Ludwig, Tuebingen (DE); Christoph Schiferle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 707 days.

(21) Appl. No.: 10/186,432

(22) Filed: Jul. 1, 2002

(65) Prior Publication Data

US 2003/0025107 A1 Feb. 6, 2003

(30) Foreign Application Priority Data

Jul. 4, 2001 (DE) ..... 101 32 437

(51) Int. Cl.

| | |
|---|---|
| ***B66B 9/04*** | (2006.01) |
| ***B66F 7/10*** | (2006.01) |
| ***B66F 7/12*** | (2006.01) |
| ***B66F 7/16*** | (2006.01) |
| ***E66F 9/00*** | (2006.01) |

(52) U.S. Cl. ..... 187/274; 254/2 C; 254/89 H; 254/89 R; 254/93 L; 254/DIG. 1; 254/DIG. 9

(58) Field of Classification Search ..... 187/203, 187/214, 215, 270–274; 74/29, 30, 422; 91/472, 502; 254/DIG. 1, DIG. 9, 93 L, 254/2 C, 89 R, 89 H See application file for complete search history.

(56) References Cited

U.S. PATENT DOCUMENTS

| | | | | |
|---|---|---|---|---|
| 859,122 | A * | 7/1907 | Scholl | 254/2 C |
| 860,622 | A * | 7/1907 | Bannerman et al. | 414/495 |
| 2,593,630 | A * | 4/1952 | Thompson | 187/218 |
| 2,750,004 | A * | 6/1956 | Harrison | 187/207 |
| 2,804,962 | A * | 9/1957 | Sherman | 198/346.2 |
| 3,053,053 | A * | 9/1962 | Douglas | 91/171 |
| 3,854,492 | A * | 12/1974 | Kita | 137/99 |
| 3,934,680 | A * | 1/1976 | Bishop | 187/206 |
| 4,096,961 | A * | 6/1978 | Rocco | 414/642 |
| 4,693,358 | A | 9/1987 | Kondo et al. | |
| 5,143,179 | A * | 9/1992 | Hornstein | 187/215 |
| 5,687,598 | A * | 11/1997 | Kirii et al. | 72/21.5 |
| 5,839,532 | A * | 11/1998 | Yoshiji et al. | 180/164 |
| 6,027,295 | A * | 2/2000 | Geppert et al. | 414/12 |
| 6,029,450 | A * | 2/2000 | Wittich | 60/571 |
| 2003/0025107 | A1 | 2/2003 | Ludwig et al. | |

FOREIGN PATENT DOCUMENTS

| | | | |
|---|---|---|---|
| EP | 1273806 | | 1/2003 |
| JP | 10146227 | | 6/1998 |
| JP | 2002084734 | A * | 3/2002 |
| KR | 2002034789 | A * | 5/2002 |
| SU | 1326511 | A * | 7/1987 |
| WO | WO 9821487 | A1 * | 5/1998 |

OTHER PUBLICATIONS

Katalog Der Anmelderin Transfersystem TS 4, Aug. 30, 1997.

* cited by examiner

*Primary Examiner*—Kathy Matecki
*Assistant Examiner*—Eric E. Pico
(74) *Attorney, Agent, or Firm*—Michael J. Striker

(57) ABSTRACT

A lifting device for a transfer system, in particular for a transfer system with a pneumatic drive, raises and/or lowers transported goods. The lifting device has at least two lifting pistons (3), whose movements are synchronized by means of a synchronization device (8, 9, 14).

6 Claims, 5 Drawing Sheets

LIFTING DEVICE WITH SYNCHRONIZATION MECHANISM

BACKGROUND OF THE INVENTION

The present invention relates to a lifting or elevating device with a synchronization mechanism, which is used in a transfer system, in particular with a pneumatic drive, in order to raise and/or lower transported goods.

Many different types of lifting or elevating devices for transfer systems are known. Typically, elevating devices in assembly and automated technologies serve to remove goods, such as work piece carriers, on transfer systems from a longitudinal segment into a transverse segment, or in the reverse, from a transfer segment of the transfer system into a longitudinal segment. In addition, elevating devices serve the purpose of lifting work piece holders from a transfer path, for example, in order to perform an operation at a machining or work station. Such types of elevating devices are known, for example, from the Catalog der Anmelderin Transfersystem TS 4, Ausgabe 3.0, 1997. Here, the elevating device has a number of pneumatic cylinders for performing the lifting movement. The pneumatic cylinders represent additional manufactures, which have very high manufacturing costs. In addition, the elevating devices themselves are constructed to be relatively high, since the cylinder rods also project at a distance from the cylinders. Therefore, when laying out the transfer system, it is usually not possible to operate several transfer segments over one another, since the elevating unit would be too high.

A further disadvantage of known elevating devices is that the individual cylinders of the elevating device are indeed commonly controllable, however, usually an asynchronous movement of the individual lifting cylinder occurs, which leads to a non-uniform lifting of the goods through the elevating device. The common control, therefore, cannot guarantee synchronous movement of the lifting cylinders. In extreme cases, this can lead to a tilting of the elevating device and to damage to the transported goods.

SUMMARY OF THE INVENTION

The elevating device of the present invention, in contrast to the known devices, has the advantage that it includes a synchronization mechanism, which synchronizes movement of at least two lifting cylinders. In this manner, a uniform, vertical movement of the lifting device is guaranteed, and tilting of the elevating device can be avoided. The synchronization mechanism synchronizes, then, the lifting movement as well as the lowering movement of the elevating device. Therefore, the elevating device of the present invention is simply constructed for a transfer system and can be manufactured inexpensively based on a plurality of similar or identical parts. The inventive synchronization mechanism makes possible a uniform and guided vertical movement without danger of a tipping or tilting of the elevating device. Especially advantageous is that all of the lifting cylinders of the elevating device are synchronized.

According to one form of the present invention, the synchronization device includes a first toothing on a shaft and a second toothing connected directly or indirectly to a respective lifting piston. The first and second toothing engage one another, whereby the shaft is connected with at least two different lifting pistons with second toothings, in order to ensure a synchronization of the movement of the different lifting pistons.

Preferably, the shaft is formed as a gear shaft, that is, the toothing is provided directly in the shaft, or a gear wheel is secured onto the shaft, in order to make available the first toothing.

According to a further preferred form of the present invention, the elevating device includes a base frame and a lifting frame. Preferably, the base frame and the lifting frame have a square or rectangular shape.

Advantageously, the shaft is mounted on the base frame and the second toothing is provided on the lifting frame.

In order to provide a compact elevating device with a simple construction, the lifting pistons preferably are disposed on the corner of the base frame and the lifting frame.

Preferably, the lifting frame is made from four profiles and four corner pieces in order to provide an elevating device that is inexpensive to manufacture and that has a plurality of the same parts. The profiles have a generally U-shaped form in cross-section. In this manner, the production of the components is simplified.

According to another preferred form of the present invention, the second toothing is disposed preferably on the inner side of the leg of the essentially U-shaped profile.

To supply the individual pistons with a pressure fluid as uniformly as possible, all of the pistons preferably are supplied with a pressure fluid via a common line. Preferably, compressed air is used as the pressure fluid. It is possible, then, to place all of the pistons under pressure at the same time with only one external pressure fluid line. It should be noted that closeable inlets can also be provided in order to connect each piston separately to an individual pressure fluid line. A simultaneous pressurizing of all of the pistons, however, favors a uniform movement.

Advantageously, each piston is held in a middle position by one or more spring elements in starting positions. Thus, it is possible, from a pressureless condition, to lift or lower the goods or work piece carriers from the middle position by means of the lifting or elevating device. The return position of the inventive elevating device takes place, respectively, by means of the spring elements. Thus, it is especially preferred that each piston has its own spring element.

It should also be noted that the elevating device of the present invention can be used in a transfer system, for example, with a turning or rotating unit, a positioning unit, or a lifting-transverse unit. Therefore, a particularly rational and standardized production of the elevating device is possible, which can be used in a modular construction with the above-named units. Because of the use of the base frame and the lifting frame, it is also possible with the inventive elevating device to enable entry from below, so that, for example, an operation can be performed on a work piece. Thus, the separation of the lifting function from the other functions, as well as the space-saving synchronization device provides a large, freely available construction for entry from below.

The present invention further relates to a transfer system, in particular in the assembly and/or automated technologies, with a lifting device of the present invention.

DETAILED DESCRIPTION OF THE PREFERRED EMBODIMENTS

FIGS. 1 through 7 show a lifting or elevating device 1 with a synchronization device for a transfer system according to one embodiment of the present invention.

Figure 1:
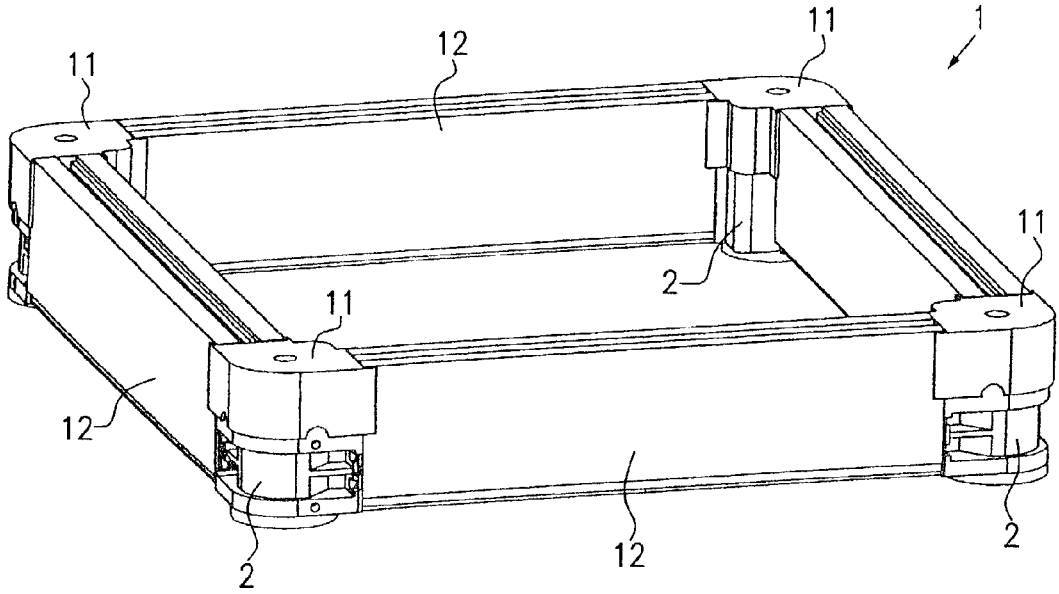
FIG. 1 shows a perspective view of an elevating device according to one embodiment of the present invention.
Figure 2:
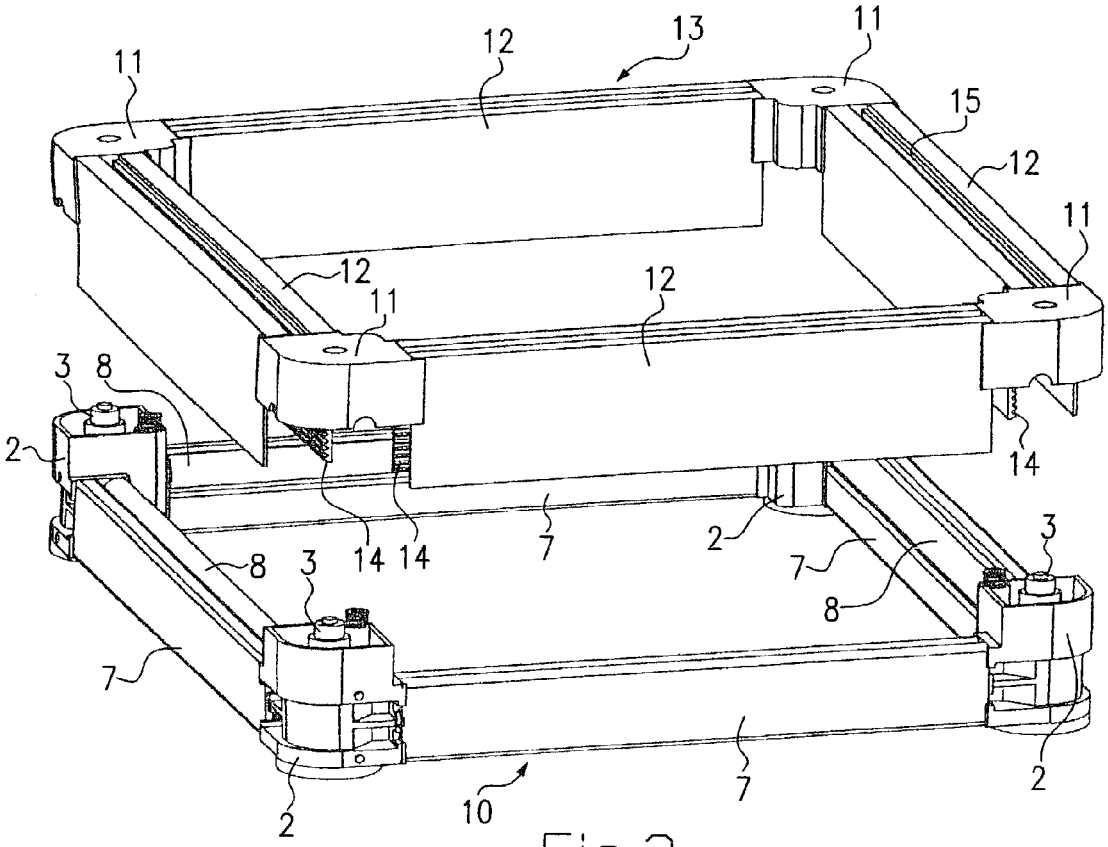
FIG. 2 shows a perspective view of the lifting device shown in FIG. 1 with the base frame and lifting frame pulled apart from one another.
Figure 3:
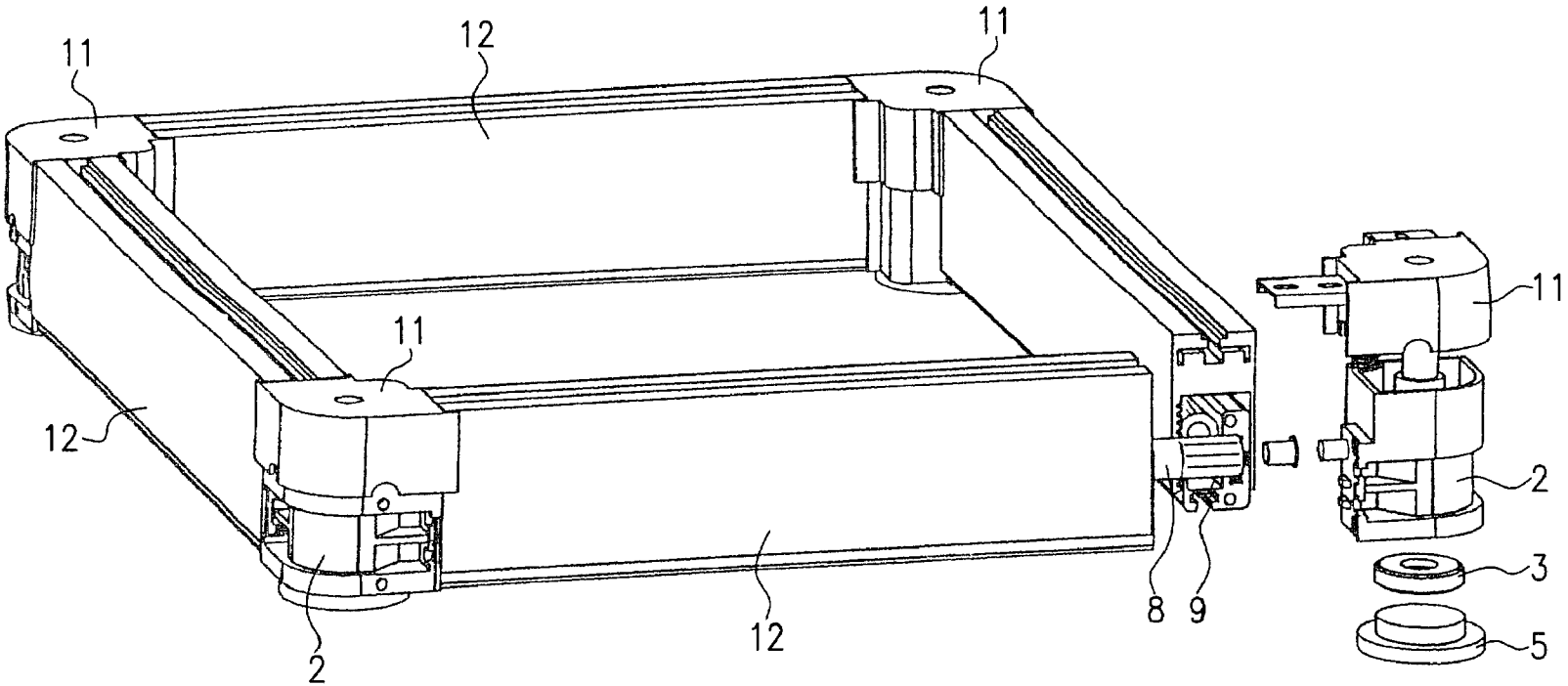
FIG. 3 shows a perspective view of the elevating device of FIG. 1 with a corner element in an exploded illustration.

As is particularly visible in FIGS. 1 through 3, the inventive elevating device 1 includes a base frame 10 and a lifting frame 13. The base frame 10 and the lifting frame 13 have the same geometric configuration in the shape of a rectangle. The base frame 10 and the lifting frame 13, therefore, are respectively modularly constructed from the same types of parts. The base frame 10 comprises four profiles 7 with the same cross section, as well as four corner elements, which are formed as cylinder bodies 2 and which connect the profiles 7, respectively, with one another. The lifting frame 13 comprises four profiles 12 having the same cross section, which are connected to one another by means of four corner pieces 11. The lifting frame 13 forms the upper support of the elevating device, on which, for example, work piece carriers or palettes can be moved and subsequently lifted or lowered. As shown particularly in FIG. 2, grooves 15 are provided in the profiles 12, in order to enable attachment of additional components of the elevating device thereon.

It should be noted that the grooves can be provided in the profiles as well as in the corner areas of the elevating device to enable mounting of upper and lower components, which provides a very flexible use of the lifting module. Further, the inventive elevating device, for example, can be combined with a lifting grid or cross-connection module, a lift-positioning module, or a lift-turn module.

Figure 4:
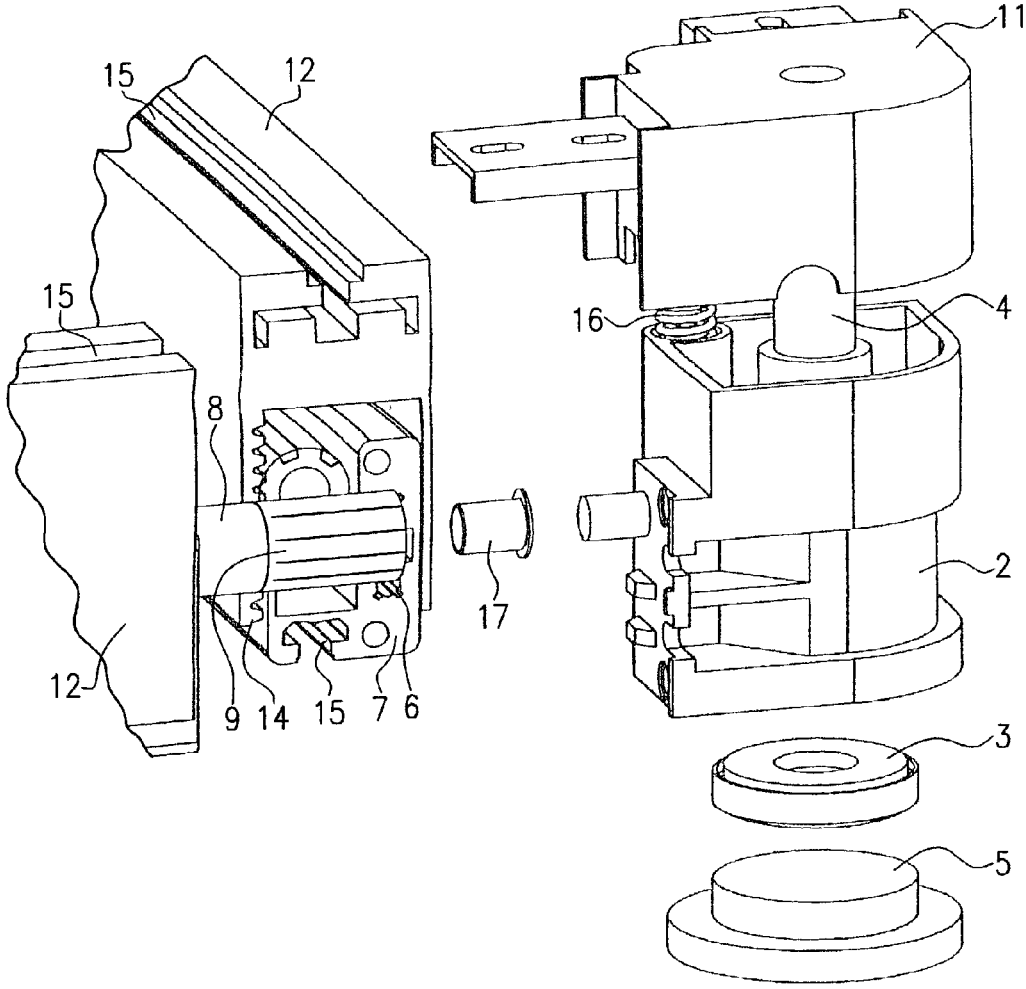
FIG. 4 is an enlarged illustration of the corner element of FIG. 3.
Figure 5:
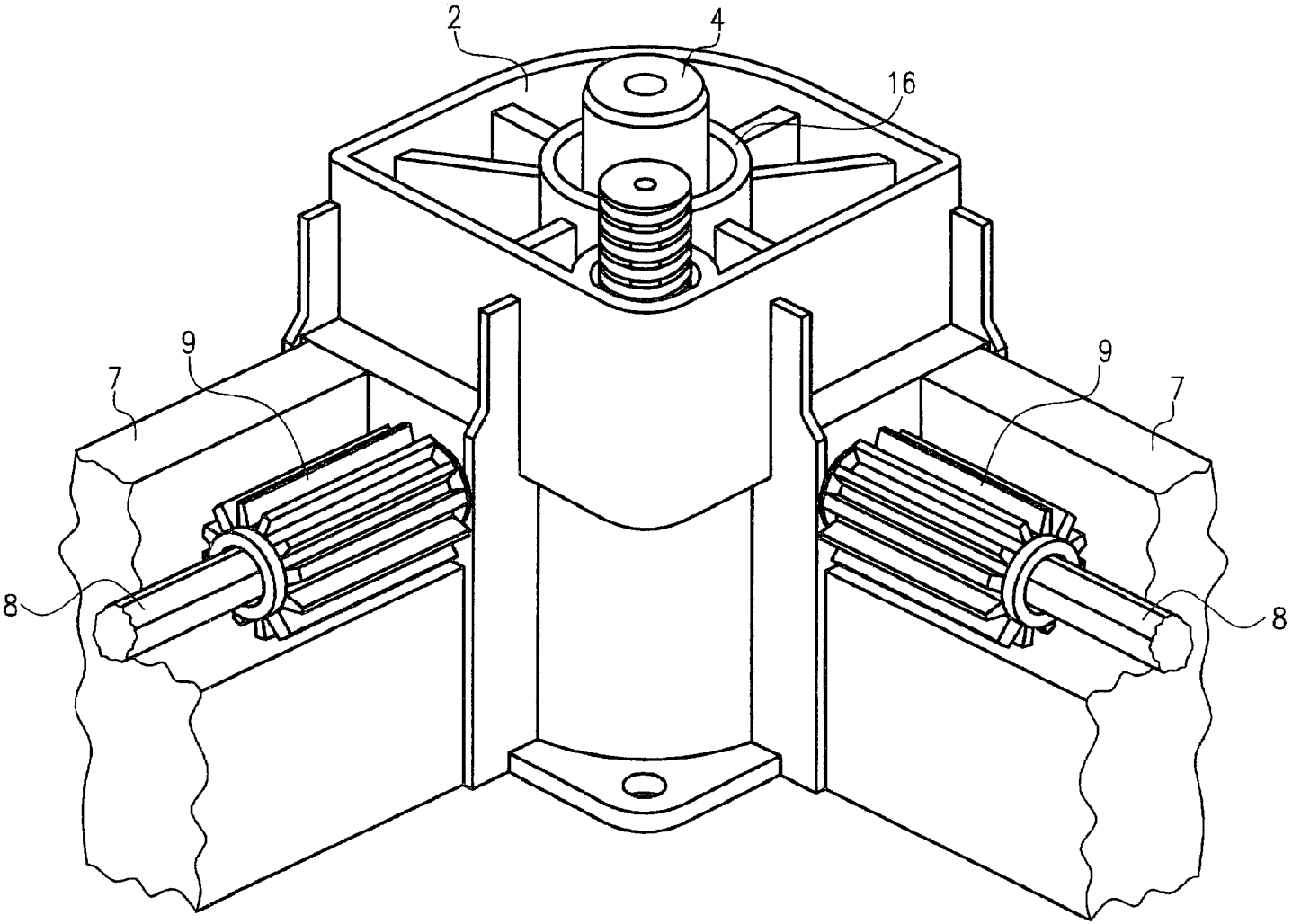
FIG. 5 is a perspective view of the corner area of the base frame.

As is particularly visible in FIGS. 3 and 4, the profile 12 of the lifting frame 13 has a substantially U-shaped cross section, which is disposed on the head and embraces the profile 7 of the base frame 10 in the initial position of the elevating device. The profile 7 of the base frame has an essentially L-shaped configuration in cross section. Parallel to the longitudinal direction of the profile 7 of the base frame, shafts 8 are disposed, which extend over the entire length of the profile 7 and each of which has a first toothing 9 on its end. The shafts 8 are supported on both of their ends on bearings 17, which are disposed in cylinder bodies 2.

As shown particularly well in FIGS. 2 and 4, on an inner wall area (leg) of the U-shaped profile 12 of the lifting frame 13, respectively, on the ends of the profile 12, a second toothing 14 is provided. These toothings 14 engage, respectively, with the toothings 9 of the shafts 8.

Further, a compressed air channel 6 is provided in the profile 7 of the base frame, which supplies the inventive elevating device 1 with compressed air. In this manner, the elevating device 1 of the present invention has only one compressed air line, over which all of the compressed air channels 6 are supplied with compressed air.

Figure 7:
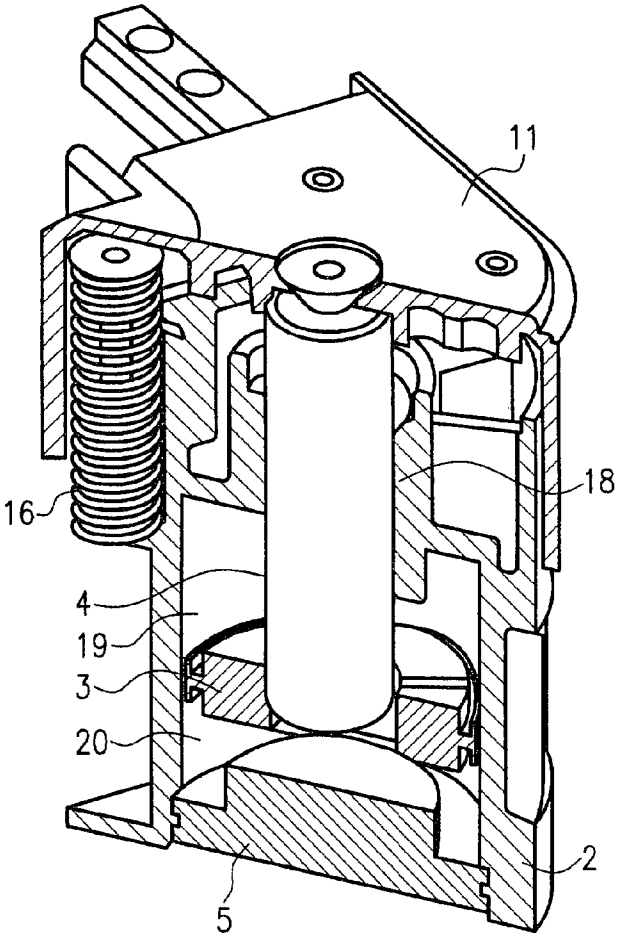
FIG. 7 is a partial cut-away view of the corner area of FIG. 6.
Figure 6:
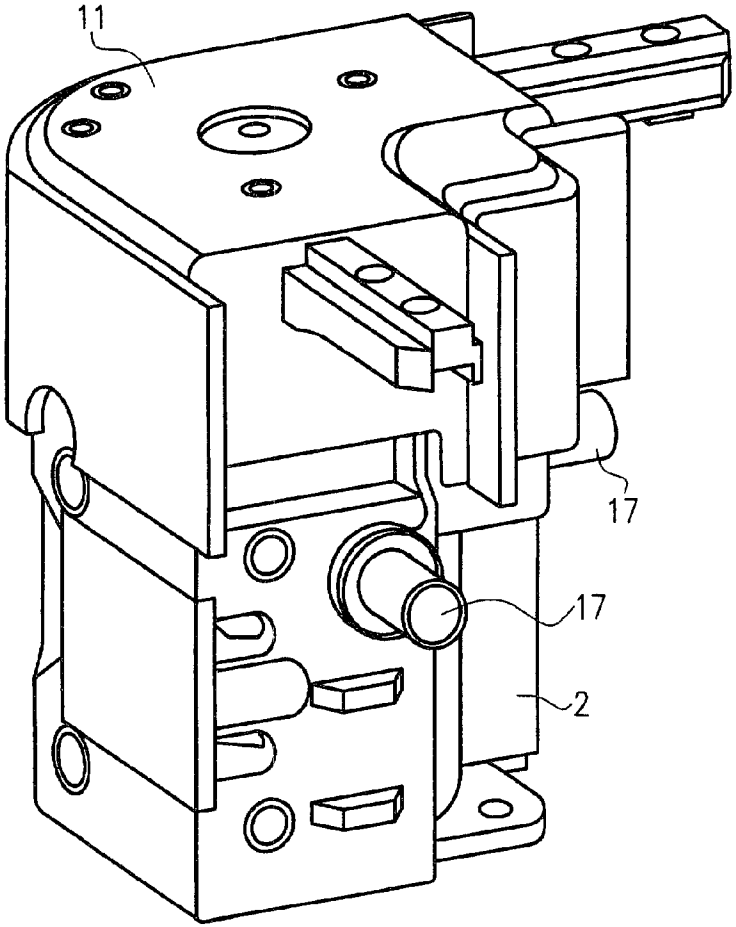
FIG. 6 is a perspective view of the corner area of the elevating device in the mounted state.

The cylinder body 2 of the elevating device is formed as a corner area and connects, respectively, the profiles 7 of the base frame 10 with one another. As shown in FIG. 7, the cylinder body 2 has a guide area 18 for guiding the piston rod 4. One end of the piston rod 4 comes into contact with the corner piece 11 and at the other end of the piston rod, a respective piston 3 is secured.

The piston 3 is preferably a double-acting piston. In this manner, the piston 3 divides a working chamber in the cylinder body 2 into a first chamber 19 and a second chamber 20. If the elevating device 1 is to perform a lifting action or a lowering action, the compressed air is supplied into one of the chambers 19 or 20, in order to enable a corresponding movement of the piston, or the piston rod. In addition, the cylinder body 2 serves to receive a spring element 16, which guides the return or reverse function in the inventive elevating device. In a pressureless state, the piston 3, then, is located in the middle position shown in FIG. 7, so that going from this middle position, either a lifting or a lowering of the lifting or elevating device is possible. The cylinder body 2 is closed by means of a cylinder floor or bottom 5.

Next, the manner of operation of the inventive elevating device with a synchronization device will be described.

When the elevating device 1, for example, is to perform a lifting action, the second chamber 20 is supplied with compressed air, so that the piston 3 and the piston rod 4 securely connected with the piston 3 moves upward (see, for example, FIG. 7). In this manner, the lifting frame 13 is lifted upward, that is, in the vertical direction. In order to make possible a synchronized lifting of the lifting frame 13, the second toothings 14, respectively, on the profiles 12 mate or engage with the first toothings 9 of the shafts 8. The shafts 8, therefore, are torsion resistant. As a result of the lifting movement of the lifting frame 13, the shafts 8 are turned via the toothings 14. In this manner, the rotational movement of the toothed shafts, which are supported on the base frame 10, is synchronized. Therefore, the torsion resistant shafts B force a synchronized vertical movement of the lifting frame 13, which takes place uniformly at all four corners. Thus, according to the example of the present invention, a mechanical synchronization device for synchronization of the lifting movement is provided. In this manner, rocking or tilting of the elevating device during the lifting process is effectively avoided.

When the lifting process is to be ended, the chambers 20 are again switched to a pressure-free state, so that the four spring elements 16 of the lifting frame 13 can be returned to their initial positions. This reversal likewise occurs synchronously by means of the engaged toothings 9 and 14, so that during the reverse movement, no tilting of the lifting frame 13 occurs.

Should a lowering action by means of the elevating device 1 be performed, the chamber 19, instead of the chamber 20, is impinged with pressure so that the double-acting piston 3 moves downwardly, whereby the spring elements 16 are pressed together. After release of the chamber 19 into the cylinder bodies 2, again a reversal takes place by means of the spring elements 16 into the initial position of the elevating device.

Since the individual lifting components of the lifting device are disposed in the corners, a particularly compact lifting device is made available, which, when compared to lifting devices of the state of the art, has an especially small vertical height. Thus, with the inventive elevating device, it is possible to plan conveying systems that can be set up over one another problem-free. The inventive synchronized lift module, then, provides a uniform and guide vertical movement, without occurrence of tilting of one of the pneumatic cylinders. Since in the exemplary embodiment set forth above, the pressure impingement of all cylinders takes place simultaneously, the synchronic movement of the individual pistons is favored. Further, since the toothings are arranged in the inner area of the U-shaped profiles 12 of the lifting frame 13, they are protected from dirt and venous other outside effects, so that only minimal maintenance costs are necessary, and the adequacy of the toothing over the entire life of the lifting device can be ensured.

Further, since the inventive elevating device preferably has a square or rectangular outer form, machining of work pieces contained in work piece carriers from below is also made possible. The inventive elevating device 1 enables an easy entry from below because it is practically made from only one frame.

Therefore, the present invention relates to a lifting device for a transfer system, in particular, with a pneumatic drive, in order to raise and/or lower transported goads. The elevating device has at least two lifting pistons cylinders 3, whose movements are synchronized by a synchronization device 8, 9, 14.

It will be understood that each of the elements described above, or two or more together, may also find a useful application in other types of constructions differing from the types described above.

While the invention has been illustrated and described herein as an elevating device with a synchronization mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A lifting device for a transfer system with a pneumatic drive for raising and/or lowering transported goods, comprising:

a base frame;

a lifting frame;

means for connecting said lifting frame with said base frame and including cylinder bodies provided on one of said frames and arranged in corners of said one frame and four corner pieces provided on the other of said frames and arranged in corners of said other frame, so that said lifting frame is connected with said base frame through said cylinder bodies and said corner pieces, said base frame being composed of four substantially L-shaped profiles, while said lifting frame is composed of four substantially U-shaped profiles; lifting means for lifting said lifting frame relative to said base frame and including at least two lifting pistons; a synchronization device provided for synchronization of movements of said at least two lifting pistons and having a shaft rotatably supported on said base frame and having a first toothing system, and a second toothing system provided on said lifting frame and meshing with said first toothing system, said first and second toothing systems being arranged in the lifting device in a protected fashion.

2. The lifting device as defined in claim 1, wherein the shaft is a serrated shaft.

3. The lifting device as defined in claim 1, wherein a gear wheel is secured to the shaft.

4. The lifting device as defined in claim 1, wherein the at least two lifting pistons disposed on corners of the base frame and the lifting frame.

5. The lifting device as defined in claim 1, wherein all of the at least two lifting pistons are supplied with pressure fluid by means of a common line.

6. The lifting device as defined in claim 1, wherein the at least two lifting pistons are retained in a middle position by spring elements at an initial position, thereby enabling raising or lowering of said lifting frame.

* * * * *